US006471793B1

(12) United States Patent
Butruille

(10) Patent No.: US 6,471,793 B1
(45) Date of Patent: Oct. 29, 2002

(54) REFINED ALUMINUM FOIL FOR ELECTROLYTIC CAPACITORS

(75) Inventor: Jean-Remi Butruille, Grenoble (FR)

(73) Assignee: Pechiney Rhenalu, Paris (FR)

( * ) Notice: Subject to any disclaimer, the term of this patent is extended or adjusted under 35 U.S.C. 154(b) by 0 days.

(21) Appl. No.: 09/504,040

(22) Filed: Feb. 14, 2000

(30) Foreign Application Priority Data

Feb. 23, 1999 (FR) ..... 99 02386

(51) Int. Cl.[7] ..... C22C 21/00
(52) U.S. Cl. ..... 148/437; 420/528; 420/554
(58) Field of Search ..... 148/437; 420/554, 420/528; C22C 21/00

(56) References Cited

U.S. PATENT DOCUMENTS 3,498,765 A 3/1970 Hunter
5,128,836 A 7/1992 Fukuoka et al.
5,518,823 A 5/1996 Fujihira et al.

FOREIGN PATENT DOCUMENTS

| | | |
|---|---|---|
| JP | 58042747 | 3/1983 |
| JP | 04062818 | 2/1992 |
| JP | 05287465 | 11/1993 |
| JP | 06330213 | 11/1994 |
| JP | 07150280 | 6/1995 |
| JP | 08003673 | 1/1996 |
| JP | 10140394 | 5/1998 |

*Primary Examiner*—Scott Kastler
*Assistant Examiner*—Janelle Combs-Morillo
(74) *Attorney, Agent, or Firm*—Dennison, Schultz & Dougherty

(57) ABSTRACT

Thin foil of refined aluminum for the manufacture of anodes for electrolytic capacitors, the foil being formed of aluminum of a purity greater than 99.9% by weight and at least one of the elements Pb, B and In with an average total content of these elements of between 0.1 and 10 ppm by weight. The elements are distributed in a surface zone of the foil at a depth of 0.1 $\mu$m, such that a signal current obtained by ionic analysis has a dispersion ratio $(I_{max}-I_{min})/I_{average}$ of less than 5.

6 Claims, 2 Drawing Sheets

Homogeneous distribution of pits resulting from homogeneous distribution of Pb, B and In on surface.

Heterogeneous distribution of pits resulting from heterogeneous distribution of Pb, B and In on surface.

Homogeneous distribution of pits resulting from homogeneous distribution of Pb, B and In on surface.

REFINED ALUMINUM FOIL FOR ELECTROLYTIC CAPACITORS

FIELD OF THE INVENTION

This invention relates to thin foils or strips made of refined aluminum with a purity exceeding 99.9%, and which are subjected to an etching surface treatment designed to increase their specific area, and are then used in the manufacture of anodes for electrolytic capacitors, and particularly high voltage capacitors.

DESCRIPTION OF RELATED ART

A lot of work has been carried out to study the effect of some trace elements in aluminum on the density of the pores obtained during the etching treatment and the capacitance of the capacitor made using foils of this aluminum. The role of lead, indium and boron in particular has been demonstrated.

The effect of lead is mentioned for the first time in U.S. Pat. No. 3,997,339 by Siemens published in 1976 that describes the influence of antimony, barium and zinc between 5 and 220 ppm, and the influence of lead and bismuth up to 0.5 ppm, and calcium and chromium up to 2 ppm. The patent application JP 58-42747 filed by Toyo Aluminium mentions the favorable effect of an indium content of 0.1 to 1 ppm for etching. The article by K. Arai, T. Suzuki and T. Atsumi "Effect of Trace Elements on Etching of Aluminum Electrolytic Capacitor Foil" Journal of the Electrochemical Society, July 1985, studies the influence of traces of bismuth and boron on the morphology of etching and the capacitance.

Some work has shown that favorable elements must be concentrated in a zone close to the surface, if they are to be fully efficient. Thus, patent application JP 57-194516-A by Toyo Aluminium published in 1982, demonstrates the beneficial effect on the etchability of a concentration of between 50 and 2000 ppm of lead, bismuth and/or indium content in the surface zone down to a depth of 0.1 $\mu$m.

Patent EP 0490574 by Showa Aluminium published in 1992 describes the concentration at different contents of Fe, Cu, Zn, Mn, Ga, P, V, Ti, Cr, Ni, Ta, Zr, C, Be, Pb and In elements, either at the interface between the surface oxide layer of the foil and the body of the foil, or within the oxide layer. The concentration ratio of elements in the concentration zone and elements in the core of the foil, as measured with an ion probe, is between 1.2 and 30.

U.S. Pat. No. 5,128,836 by Sumitomo Light Metal published in 1992 describes the concentration of Pb, Bi and/or In at a content of between 10 and 1000 ppm in a sub-surface zone at a depth of between 0. 1 and 0. 2 $\mu$m. Proposed methods to encourage surface migration of the various elements are either heat treatments, for example final annealing under special conditions, or physical deposits such as cathodic sputtering or ion implantation.

Finally, it is known that low capacitances are obtained when etching is not uniform at the surface of the foil. The link between these etching heterogeneities and the surface distribution of elements like Pb, Bi or In has not been clearly established, as can be seen in the articles by W. LIN et al. "The Effect of Lead Impurity on the DC-Etching Behaviour of Aluminum Foil for Electrolytic Capacitor Usage" Corrosion Science, vol. 38, No. 6, 1996, pp. 889–907, and "The Effect of Indium Impurity on the DC-Etching Behaviour of Aluminum Foil for Electrolytic Capacitor Usage", Corrosion Science, vol. 39, No. 9, 1997, pp. 1531–1543.

SUMMARY OF THE INVENTION

The purpose of the invention is to improve the beneficial effect of the surface concentration of Pb, B and In elements on the etchability of thin foils of refined aluminum for electrolytic capacitors. It is based on the demonstration of the favorable effect of a uniform distribution of these three elements at the surface of the foil.

The purpose of the invention is a thin foil of refined aluminum with a purity exceeding 99.9% of aluminum designed for the manufacture of anodes of electrolytic capacitors comprising at least one of the elements Pb, B and In with an average total content (by weight) of between 0.1 and 10 ppm (and preferably between 0.5 and 5 ppm) for which the distribution of these three elements in the surface zone at a depth of 0.1 $\mu$m is such that their signal current obtained by ionic analysis has a dispersion ratio $Rd=(I_{max}-I_{min})/I_{average}$ less than 5, and preferably less than 2.

DETAILED DESCRIPTION OF THE INVENTION

Figure 1:
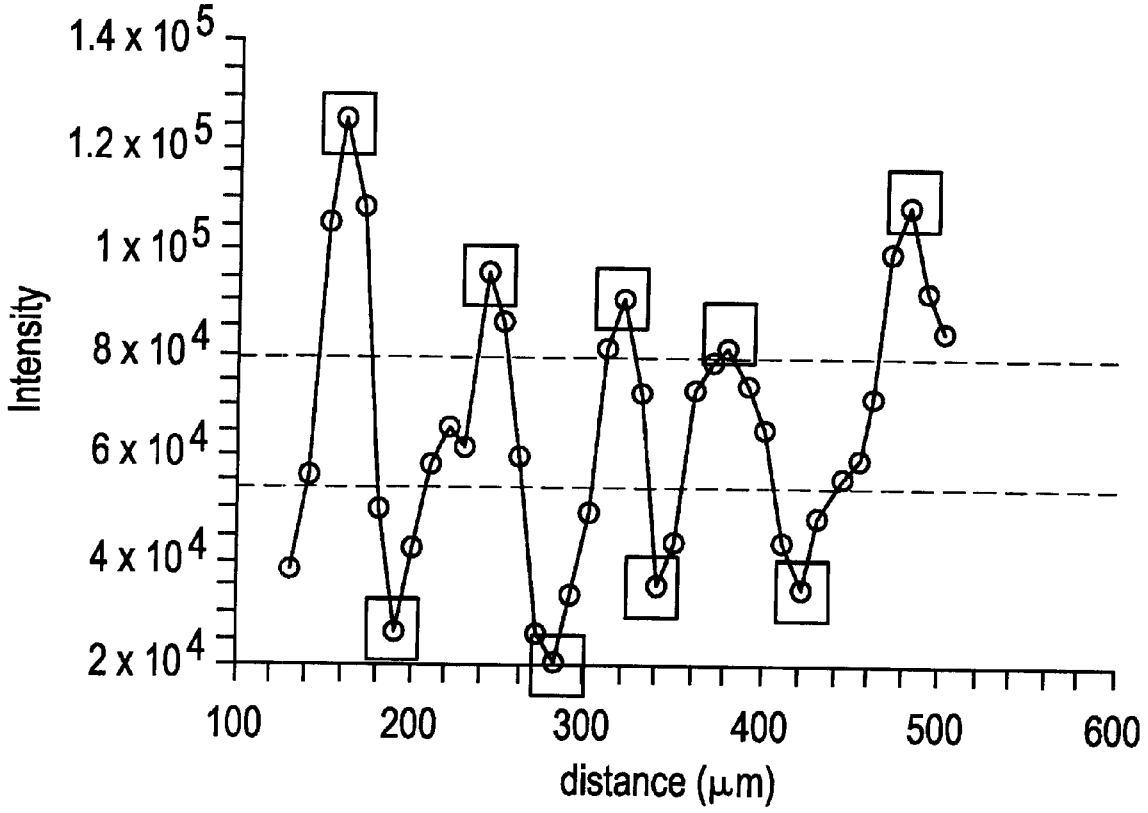
FIG. 1 shows an example of the current profile obtained by ionic analysis for an element, on a logarithmic scale, as a function of the advance distance (in $\mu$m) perpendicular to the foil rolling direction, and the determination of the maximum, minimum and average currents necessary to calculate the dispersion ratio.

Thin aluminum foils used for the manufacture of electrolytic capacitor electrodes are made using refined aluminum with a purity of at least 99.9%. The refining process used may either be a "13 layer" electrolytic refining process as described in patents FR 759588 and FR 832528, or a segregation process as described in patent FR 1594154. The metal is then hot rolled and then cold rolled to the final thickness which is of the order of 0.1 mm.

It is known that the addition of 0.1 to 10 ppm of aluminum (by weight) and preferably 0.5 to 5 ppm of lead, boron and/or indium, can improve the etchability of the foil, and therefore the electrical characteristics of the capacitor, particularly when these elements are concentrated at the surface of the foil with a content of between 10 and 1000 ppm in the 1 $\mu$m thick surface zone. This concentration in the surface zone is obtained according to prior art by a final annealing treatment at a temperature of between 400 and 600° C. for a sufficiently long period, usually several hours.

Figure 2A:
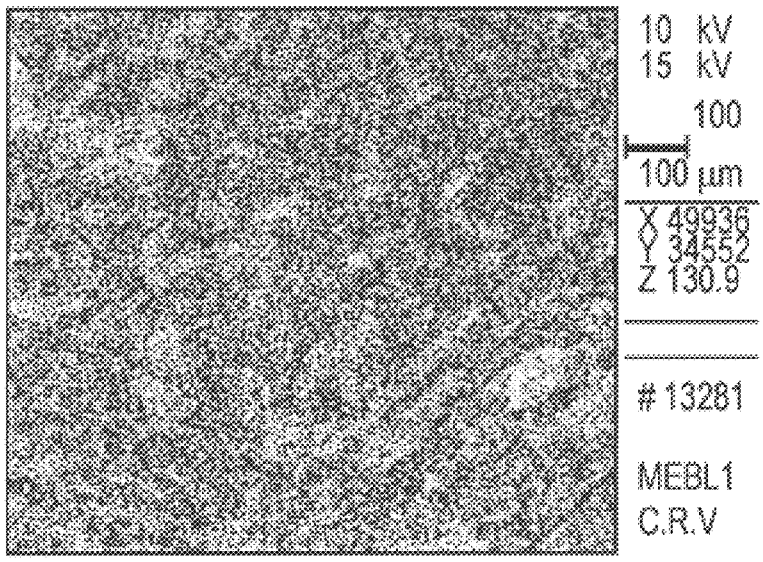
FIGS. 2*a* and 2*b* are micrographs illustrating the distribution of the pits after etching resulting from uniform distribution and homogeneous distribution respectively of elements Pb, B and In at the surface of the foil.
Figure 2B:
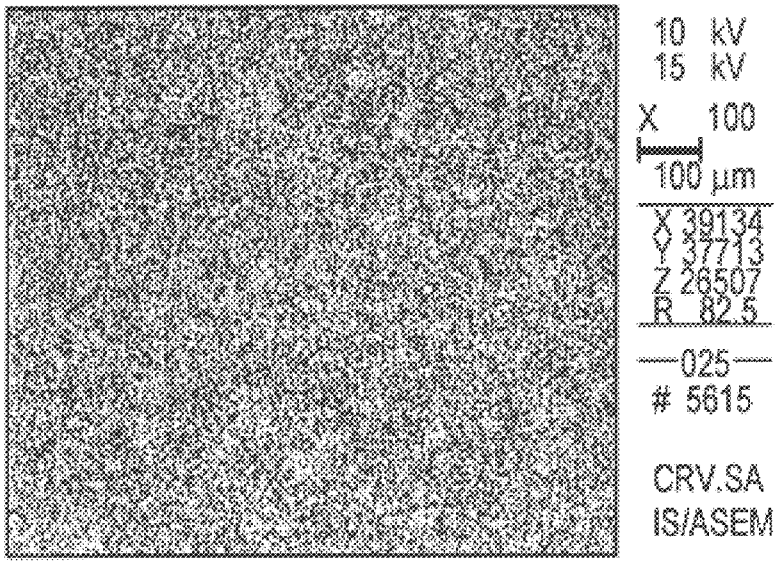

According to the invention, the dispersion ratio $Rd=(I_{max}-I_{min})/I_{average}$ is less than 5 and is preferably less than 2 for each of the elements Pb, B and In. The currents are measured using a SIMS (Secondary Ion Mass Spectrometry) type ion spectrometer, using the "step-scan" method. In the mode used, the advance step is 10 $\mu$m and the abraded zone is a square with a 250 $\mu$m side. These parameters are suitable for the scale of heterogeneities observed in etching as shown in FIG. 2.

The average signal current $I_{average}$ for an element is obtained by calculating the arithmetic mean of currents measured on the profile. The upper limiting current $I_{max}$ is the arithmetic mean of the maximum currents obtained as follows: they are defined by the current at the second point of three consecutive analysis points with a maximum current on the second point. Only maxima that exceed a threshold fixed slightly above the average current will be retained. Similarly, the low limiting current $I_{min}$ is the arithmetic mean of the currents obtained when a minimum is observed on the second of three successive analysis points, retaining only the currents that exceed a given threshold located slightly below the average current.

This method is illustrated by the diagram in FIG. 1, representing the current profile as a function of the distance traveled by the ion spectrometer on the sample. Measurement points are represented by a small circle, and the points selected as being the minimum and maximum currents are shown surrounded by a square, which are located outside the strip delimited by the two threshold lines.

The distribution of elements Pb, B and In according to the invention is obtained by a process comprising the following steps:

casting with mechanical vibration of the hot tank, of a refined aluminum plate with purity exceeding 99.9% and a total content of Pb+B+In of between 0.1 and 10 ppm, homogenization at a temperature exceeding 580° C., for a duration exceeding 20 h, hot rolling, and possibly cold rolling, to give a final thickness of between 8 and 3 mm, intermediate annealing at a temperature exceeding 400° C., for a duration of between 1 and 100 h, preferably under a neutral gas, cold rolling to a thickness of between 0.115 and 0.18 mm, recovery annealing at between 200 and 280° C. for 1 to 80 h, final cold rolling to give a thickness of between 0.085 and 0.125 mm, final annealing between 540 and 600° C. for 1 to 50 h.

The various annealing operations are preferably carried out under a neutral gas, for example argon.

The inventors have put forward the theory that mechanical vibration during casting and/or the combination of heat treatments at a temperature higher than temperatures known according to prior art give better uniformity of the distribution of elements Pb, B and In. This uniformity of the distribution of these elements gives a more homogeneous distribution of the pits after etching, as shown by comparing the micrographs taken by scanning electron microscopy and as shown in FIGS. 2*a* (according to prior art) and 2*b* (according to the invention).

EXAMPLES 8 samples of refined aluminum foil with a purity of 99.99% with the additive elements indicated in table 1 were prepared as follows:

casting with mechanical vibration of a plate and homogenize this plate for 30 h at 600° C., hot and cold rolling to a thickness of 6 mm, intermediate annealing for 15 h at a temperature of 450° C. under argon, cold rolling to a thickness of 0.125 mm, intermediate annealing for 35 h at a temperature of 250° C., cold rolling to 0.1 mm, final annealing for 10 h at 580° C. under argon.

Four comparison samples were prepared using a known process, namely:

casting (without mechanical vibration) of a plate and homogenization for 30 h at 550° C., hot and cold rolling to 6 mm, intermediate annealing for 40 h at a temperature of 200° C., cold rolling to a thickness of 0.1 mm, final annealing for 10 h at 580° C. under argon.

The content of elements Pb, B and In in the surface zone was measured using an IMS 5F ion probe made by the CAMECA company with the following parameters:

primary ion: xenon acceleration voltage: 8.5 kV primary current: 30 nA crater size: 250×250 μm beam size: 30 μm analyzed area: 2×2 μm displacement step: 10 μm total displacement: 500 μm Under these conditions, abrasion conditions are stable after a displacement of 125 μm. Therefore the first 125 microns of each side profile are systematically ignored. The analysis depth is less than 0.1 μm. The measurements are made at several locations in order to give statistically reliable values. The average, maximum and minimum currents were measured on each sample, for each element using the method described above, and the dispersion ratio Rd was calculated in each case.

The value of the capacitance of the capacitors made from samples etched using the process described below was then measured. The aluminum foils are electrolyzed in a solution containing 5% HCl and 15% $H_2SO_4$ with a DC density of 200 mA/cm$_2$, for 60 s at 850° C. The foils are then dipped into a 5% HCl solution for 8 minutes. Oxide is formed at a voltage of 450 V in an ammonium borate solution. The capacitance is measured in μF/cm$^2$, and is then corrected to be expressed as a percentage related to a reference refined foil. The results obtained are shown in table 1.

TABLE 1

| Sample | Pb (ppm) | B (ppm) | In (ppm) | Rd Pb | Rd B | Rd In | Cap. (%) |
|---|---|---|---|---|---|---|---|
| 1 | 0.3 | <0.1 | 0.2 | 2.5 | — | 1.7 | 105 |
| 2 | 0.5 | <0.1 | 0.2 | 1.3 | — | 1.6 | 104 |
| 3 | 0.2 | 0.2 | <0.1 | 1 | 1.9 | — | 98 |
| 4 | 0.3 | <0.1 | 0.3 | <0.1 | 0.2 | 1.3 | 112 |
| 5 | 0.6 | 1.2 | 0.2 | 2.0 | 2.2 | 1.4 | 105 |
| 6 | 0.8 | 2.5 | 0.1 | 1.8 | 2.1 | — | 104 |
| 7 | 0.3 | 1.1 | 0.7 | 1.4 | 1.1 | 1.3 | 110 |
| 8 | 0.5 | <0.1 | 1.1 | 1.8 | 0.9 | 1.1 | 105 |
| 9 | 0.3 | <0.1 | 0.2 | 5.2 | — | 2.0 | 95 |
| 10 | 0.8 | 2.1 | <0.1 | 3.2 | 7.3 | — | 92 |
| 11 | 0.4 | 1.5 | 0.7 | 3.1 | 2.5 | 6.1 | 96 |
| 12 | 0.3 | 0.5 | 0.2 | 6.1 | 8.2 | 1.2 | 93 |

It can be seen that there is an improvement in the capacitance for samples 1 to 8, for which the dispersion ratio for the three elements considered is less than 5, compared with the four samples 9 to 12 for which the dispersion ratio is greater than 5 for at least one of the elements.

What is claimed is:

1. Thin foil of refined aluminum for the manufacture of anodes for electrolytic capacitors, said foil comprising aluminum of a purity greater than 99.9% by weight and at least one of the elements Pb, B and In with an average total content of said elements of between 0.1 and 10 ppm by weight, said elements being distributed in a surface zone of said foil at a depth of 0.1 μm, such that a signal current obtained by ionic analysis has a dispersion ratio $(I_{max}-I_{min})/I_{average}$ of less than 5.

2. Thin foil according to claim 1, wherein the dispersion ratio is less than 2.

3. Thin foil according to claim 1, wherein said average total content is between 0.5 and 5 ppm by weight.

4. Thin foil according to claim 1, which is obtained by casting with mechanical vibration.

5. Thin foil according to claim 1, which is obtained by casting, followed by homogenization at a temperature greater than 580° C. for a period in excess of 20 hours.

6. Thin foil according to claim 1, which is obtained by casting followed by a final annealing at a temperature of 540 to 600° C. for 1 to 50 hours.

* * * * *